United States Patent [19]

Dupuy

[11] Patent Number: 4,505,011

[45] Date of Patent: Mar. 19, 1985

[54] SAFETY BELT ANCHOR

[75] Inventor: James A. Dupuy, Vicksburg, Miss.

[73] Assignee: Letourneau Company, Longview, Tex.

[21] Appl. No.: 467,163

[22] Filed: Feb. 16, 1983

[51] Int. Cl.[3] ..... B25B 1/20

[52] U.S. Cl. ..... 24/540; 24/132 R; 24/132 WL; 24/135 R; 81/418; 81/420; 269/41; 269/156

[58] Field of Search ..... 24/540, 497, 629, 132 R, 24/132 WL, 135 R, 704; 269/156, 41; 81/418, 420, 421; 248/217.1, 231.5, 71

[56] References Cited

U.S. PATENT DOCUMENTS

| | | | |
|---|---|---|---|
| 1,102,384 | 7/1914 | Bernard | 81/418 |
| 1,450,875 | 4/1923 | Teselsky | 81/418 |
| 1,480,147 | 1/1924 | Brandt | 248/71 |
| 2,329,508 | 9/1943 | Andrews et al. | 24/540 |
| 2,356,400 | 8/1944 | Hanson | 81/421 |
| 2,999,290 | 9/1961 | Giles | 182/107 |
| 3,184,838 | 5/1965 | Johnson | 81/418 |
| 3,314,319 | 4/1967 | Schmidt | 81/420 |
| 3,348,632 | 10/1967 | Swager | 182/3 |
| 3,395,724 | 8/1968 | Hamel | 81/418 |
| 4,238,123 | 12/1980 | Bardes | 269/41 |

FOREIGN PATENT DOCUMENTS

| | | | |
|---|---|---|---|
| 77339 | 7/1919 | Austria | 24/132 WL |
| 530799 | 8/1955 | Italy | 24/132 R |
| 155140 | 12/1920 | United Kingdom | 24/132 WL |

*Primary Examiner*—Victor N. Sakran

*Attorney, Agent, or Firm*—Cushman, Darby & Cushman

[57] ABSTRACT

A secure safety anchor that is easy to utilize is provided for attachment to structural angle irons in marine installations and the like. The anchor includes a vise grips with movable and stationary jaws, and a head welded to the stationary jaw. A flange surface portion of the head extends substantially perpendicular to an imaginary line between the vise grips jaws when in the clamping position, and a number of force concentrating set screws pass through the flange surface at an angle of about 15 degrees with respect to the imaginary line. A through-extending opening in the head provides for attachment of a safety belt clasp.

20 Claims, 2 Drawing Figures

9
10
11
12
13
14
16
17
19
22
23
24
25
29
30
31
32
35
36
37
38

SAFETY BELT ANCHOR

BACKGROUND AND SUMMARY OF THE INVENTION

In many types of constructions, particularly marine-type constructions such as barges, tanks, and ships, angle irons are utilized to stiffen bulkhead plates against hydrostatic pressure that the plates will encounter in use. The angle irons are usually welded to the plates so that one arm of the angle iron extends horizontally and is attached to the plate (which comprises a wall means), while the other arm of the angle iron extends generally vertically and is spaced from the plate. The angles are usually placed on 24 inch spaced increments. During construction and repair procedures, workers use the angles as ladders to climb the walls of the tank, ship, or the like.

According to the present invention a safety belt anchor system, and an anchoring procedure, are provided which minimize the chances of worker injury due to a fall off the angle irons when the worker is working at elevated areas. The structure according to the invention is extremely simple to attach in place, requiring only one-hand operation. Yet the anchor is extremely effective, and will not slip should the worker fall, and the force of his fall will be transmitted to the anchor by a safety belt.

The anchoring structure according to the invention includes a conventional vise grips, having a stationary jaw, a movable jaw, jaw movement lever means, and adjustment means for adjusting the spacing between the jaws when in a clamping position. An imaginary line extends substantially parallel to the jaws, and between the jaws, when they are in the clamping position. The structure further comprises a head which is welded, or otherwise affixed, to the stationary jaw, and includes force concentrating means associated therewith. Preferably, the head includes a flange surface which extends substantially perpendicular to the imaginary line, with the force concentrating means preferably comprising pointed set screws—passing through the flange surface at an acute angle (e.g. about 15 degrees) to the imaginary line. A through-extending opening for receiving the clasp of a safety belt—or other safety belt attachment means—is associated with the head.

In utilizing the safety belt anchor according to the invention, a worker climbs up the angle irons to the desired work area and then with one hand moves the anchor into position with respect to an angle iron that is at, or above, the desired work area. The set screws are moved into contact with the horizontally extending arm of the angle iron, while the stationary jaw is moved into contact with the vertically extending arm of that angle iron. Then the worker—with one hand—actuates the movable jaw lever, so that the movable jaw moves into position against the angle iron vertically extending arm, clamping the vertically extending arm between it and the stationary jaw.

If desired, two safety anchors may be utilized that are horizontally spaced, with a safety belt hooked to each.

It is the primary object of the present invention to provide an easy to use, and effective, safety anchor—and method of utilization thereof—for utilization with structural angle irons. This and other objects of the invention will become clear from an inspection of the detailed description of the invention, and from the appended claims.

DETAILED DESCRIPTION OF THE DRAWINGS

Figures 1, 2:
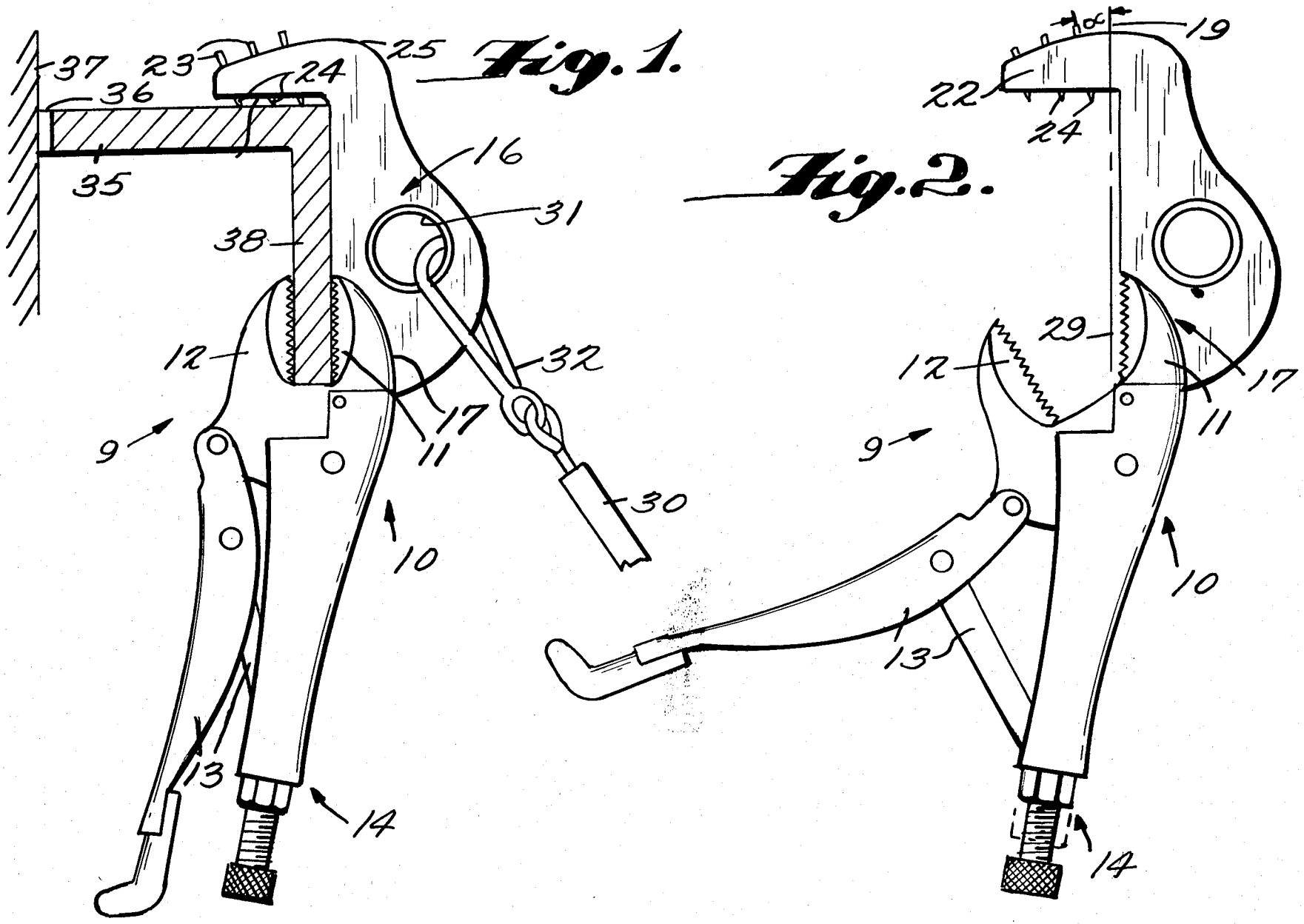
FIG. 1 is a side view of a safety anchor according to the present invention shown in anchoring position with respect to an angle iron.
FIG. 2 is a side view of the safety anchor of FIG. 1 in a non-operative position.

A safety anchor 9 according to the present invention includes conventional vise grips 10, such as a 10 inch vise grips. The conventional components of the vise grips 10 include the stationary jaw 11, and movable jaw 12, the lever means 13 for effecting movement of the movable jaw 12 with respect to the stationary jaw 11, and adjustment means 14 for adjusting the spacing between the jaws 11, 12 in the clamping position thereof (the FIG. 1 position). The adjustment means 14 can provide for an adjustment in the spacing of the jaws 11, 12 from at least about one-quarter inch to about five-eighths inch.

Affixed to the stationary jaw 11 is a head 16. The head 16 may be affixed to the jaw 11 by a weld 17 or the like. The head 16 includes a surface 18 extending generally parallel to an imaginary straight line 19, which line 19 is substantially parallel to the jaws 11, 12 when in the clamping position, and extends therebetween.

The head 16 also includes reaction force applying means for applying a force vector in a direction substantially perpendicular to the line 19. Such reaction force applying means preferably comprise a flange surface 22 of the head 16 which extends substantially perpendicular to the surface 18 and the imaginary line 19, and includes a plurality of force concentrating means associated therewith. Such force concentrating means preferably take the form of a plurality of set screws 23, each having a pointed end portion 24 which penetrates the flange surface 22. The slotted ends of the set screws 23 may be made flush with the outer surface 25 of the head portion 16, if desired.

The set screws 23 make an acute angle with imaginary line 19, as seen most clearly in FIG. 2. The angle $\alpha$ is formed by a projection of a set screw 23 intersecting the line 19 between the surface 22 and the jaws 11, 12. The angle $\alpha$ preferably is about 15 degrees. Both horizontal and vertical reaction force vectors are provided by the points 24. The spacing between a center portion 29 of the jaws 11, 12 and the flange surface 22 is preferably about 3.5–4 inches.

The head 16 further comprises means for facilitating attachment of a safety belt 30 thereto. Such means preferably take the form of means defining a through-extending opening 31 in the head 16 adjacent the stationary jaw 11 and remote from the surface 22. The opening 31 extends in a dimension substantially perpendicular to both the surface 22 and the imaginary line 19. The opening 31 is ideally suited for receipt of a conventional clasp 32 or the like associated with a conventional safety belt 30.

In the utilization of the safety anchor 9 according to the invention, a worker climbs up a plurality of angle irons in a marine installation or the like. Each of the angle irons—as seen in FIG. 1—includes a horizontally extending arm portion 35 which is welded at 36 to a plate 37 or the like, comprising wall means. A vertically extending arm portion 38 of the angle iron is substantially perpendicular to the arm 35, and spaced from the plate—walls means 37.

When the worker reaches the correct height for his/her desired work area, the worker moves the safety anchor 9 into operative association with an angle iron at, or above, that work area. This is accomplished by taking the anchor 9 with the relative positioning of the components illustrated in FIG. 2, and moving the set screw points 24 into contact with the top of the horizontal arm 35, and the stationary jaw 11 into contact with the exterior surface of the vertical arm 38 of the angle iron. This can be done with one hand. Then to clamp the anchor into place, the worker need only effect movement of the lever means 13—again only one hand operation being necessary—to move the movable jaw 12 into contact with the interior surface of the vertical angle iron arm 38, so that the arm 38 is clamped between the jaws 11, 12. The worker then inserts the clasp 32 of the safety belt 30 through the opening 31, and is protected against a catastrophic fall.

If desired, especially where the worker will have to reach a great distance, assume an unusual position, or perform especially difficult tasks, two anchors 9 may be utilized, and they may be placed in association with an angle iron at horizontally spaced positions thereof.

The jaws 11, 12 may be easily adjusted utilizing the adjustment means 14 to accommodate different angle irons and provide the appropriate clamping pressure, and by simple adjustment of the set screws 24 the desired effective action thereof can also be achieved.

While the anchor 9 according to the invention is extremely simple to use, it is effective. In a test conducted by dropping a 200 lb. sandbag five feet with the sandbag operatively attached to a safety belt 30 attached to the anchor 9, the sudden jerk produced when the safety belt stopped the load in mid-air did not cause release of the anchor. Rather the anchor effectively arrested the fall of the sandbag.

It will thus be seen that the structure and method according to the present invention provide for the simple and effective anchoring of a worker in a marine environment, or other work area, where angle iron structural components are utilized. While the invention has been herein shown and described in what is presently conceived to be the most practical and preferred embodiment thereof, it will be apparent to those of ordinary skill in the art that many modifications may be thereof within the scope of the invention, which scope is to be accorded the broadest interpretation of the appended claims so as to encompass all equivalent structures and methods.

What is claimed is:

1. A structure for anchoring onto an angle iron or the like, comprising:

vise grips, including a stationary jaw, movable jaw, and jaw movement lever means;

an imaginary straight line extending between said stationary and movable jaws substantially parallel thereto when said jaws are in a clamping position;

a head fixed to said stationary jaw;

said head including a flange surface portion thereof extending in a dimension substantially perpendicular to, and intersecting, said imaginary line; and said surface portion being spaced from all portions of said stationary jaw a substantial distance along said imaginary line, so that when a first portion of an angle iron is received between said stationary and movable jaws, a second portion of angle iron, generally perpendicular to the first portion, is operatively engaged by said surface portion; and means defining a through-extending opening in said head, extending in a dimension generally perpendicular to both said flange surface and said imaginary line, and formed in a portion of said head remote from said flange surface and adjacent said vise grip stationary jaw.

2. A structure as recited in claim 1 wherein said head is welded to said stationary jaw.

3. A structure as recited in claim 1 further comprising a plurality of set screws extending through said flange surface.

4. A structure as recited in claim 3 wherein each of said set screws has a pointed tip, and is disposed so that a projection thereof intersects said imaginary line between said jaws and said flange surface, and makes an acute angle with respect thereto.

5. A structure as recited in claim 4 wherein said acute angle is approximately 15 degrees.

6. A structure as recited in claim 1 wherein said vise grip further comprises means for adjusting the spacing between said stationary movable jaws when in a clamping position.

7. A structure as recited in claim 1 wherein the spacing between a center portion of said stationary and movable jaws and said flange surface is approximately 3.5–4 inches.

8. A safety anchor comprising:

vise grips including a stationary jaw and a movable jaw, and an imaginary straight line extending between said jaws substantially parallel thereto when the jaws are in a clamping position;

a head fixed to said stationary jaw;

said head including a portion thereof comprising reaction force applying means for applying a force vector in a direction substantially perpendicular to said imaginary line; and safety belt receiving means associated with said head and vise grips for facilitating attachment of a safety belt thereto.

9. A structure as recited in claim 8 wherein said safety belt receiving means comprises a through-extending opening formed in said head adjacent said stationary jaw.

10. A structure as recited in claim 8 wherein said head is welded to said stationary jaw.

11. A structure as recited in claim 8 wherein said reaction force applying means comprises a flange surface of said head; said flange portion extending in a dimension substantially perpendicular to said imaginary line, and spaced along said line a significant distance from said stationary jaw.

12. A structure as recited in claim 11 further comprising a plurality of set screws extending through said flange surface.

13. A structure as recited in claim 12 wherein each of said set screws has a pointed tip, and is disposed so that a projection thereof intersects said imaginary line between said jaws and said flange surface, and makes an acute angle with respect thereto.

14. A structure as recited in claim 9 wherein said reaction force applying means comprises a flange surface of said head, said flange portion extending in a dimension substantially perpendicular to said imaginary line.

15. A structure as recited in claim 14 further comprising a plurality of set screws extending through said flange surface.

16. A structure as recited in claim 8 wherein said reaction force applying means comprise a plurality of force concentrating members associated with said head, and spaced from said jaws, said force concentrating members each for applying a force vector substantially perpendicular to said imaginary line, and substantially parallel to said imaginary line.

17. A structure as recited in claim 16 wherein the spacing between said force concentrating means and a center point of said jaws along said imaginary line is about 3.5–4 inches.

18. In combination an anchoring structure and an angle iron;

said angle iron comprising a first portion and a second portion generally perpendicular to said first portion;

said anchoring structure comprising: vise grips, including a stationary jaw, movable jaw, and jaw movement lever means; an imaginary straight line extending between said stationary movable jaws substantially parallel thereto when said jaws are in a clamping position; a head fixed to said stationary jaw; said head including a flange surface portion thereof extending in a dimension substantially perpendicular to, and intersecting, said imaginary line, and spaced from said stationary jaw along said imaginary line; and safety belt receiving means associated with said head and said vise grip for facilitating attachment of a safety belt thereto.

19. A structure as recited in claim 18 further comprising a plurality of set screws extending through said flange surface.

20. A structure as recited in claim 19 wherein each of said set screws has a pointed tip, and is disposed so that a projection thereof intersects said imaginary line between said jaws and said flange surface, and makes an acute angle with respect thereto.

* * * * *